US006276959B1

(12) United States Patent
Manresa

(10) Patent No.: US 6,276,959 B1
(45) Date of Patent: Aug. 21, 2001

(54) LATERAL INSERTION CONNECTOR

(75) Inventor: Xavier Secall Manresa, Tarragona (ES)

(73) Assignee: Lear Automotive Dearborn, Inc., Southfield, MI (US)

( * ) Notice: Subject to any disclaimer, the term of this patent is extended or adjusted under 35 U.S.C. 154(b) by 0 days.

(21) Appl. No.: 09/365,603

(22) Filed: Jul. 30, 1999

(30) Foreign Application Priority Data

Feb. 1, 1999 (ES) ..... 9700255

(51) Int. Cl.[7] ..... H01R 12/24; H01R 13/58; H01R 13/40

(52) U.S. Cl. ..... 439/499; 439/460; 439/733.1

(58) Field of Search ..... 439/733.1, 499, 439/460

(56) References Cited

U.S. PATENT DOCUMENTS 5,120,235 * 6/1992 Kashiwa ..... 439/405
5,577,930 * 11/1996 Dahlem et al. ..... 439/399
5,591,045 * 1/1997 Pepe et al. ..... 439/460
5,593,321 * 1/1997 Hotea ..... 439/589

* cited by examiner

*Primary Examiner*—Paula Bradley
*Assistant Examiner*—Edwin A. León
(74) *Attorney, Agent, or Firm*—MacMillan, Sobanski & Todd, LLC

(57) ABSTRACT

A connector 10 for making electrical terminal connections facilitates making relatively easy and secure lateral insertions of one or more terminals. The connector 10 includes a pair of lateral supports 12 at opposite ends of a plurality of generally aligned walls 14. The walls 14 define a plurality of cells 20 between them. Each of the walls 14 supports a protuberance 15 on one side of the walls preferably at a generally central location along the length of the walls. One end of the walls includes a tab 18 supported on each side of the walls such that each of the cells 20 includes one protuberance 15 and two tabs 18. The protuberances facilitate proper terminal placement while each set of two tabs cooperate to form a wire holding portion within each cell. The lateral supports 12 and walls 14 are supported by first and second lateral bases 13, 11 that are configured and positioned to allow easy lateral insertion of terminals and further secure the position of the terminals within the connector.

11 Claims, 1 Drawing Sheet

LATERAL INSERTION CONNECTOR

BACKGROUND OF THE INVENTION

This invention generally relates to a connector device for making electrically sound connections by a lateral insertion process.

There exists in the market, and therefore can be considered the state of the art, a plurality of connector types, which specifically function to join, the connector and an assembly of wires having in their ends the corresponding terminals, which lodge into the connector's interior in a single body.

The disposition of a plurality of male and female terminals into the respective connectors provides electrical continuity in complex electric installations such as those used in automobiles, for example.

There are several difficulties appearing when inserting the terminals into the inside of the connectors. First, the terminals need to be kept well positioned in the connector. Second, once the terminals are introduced inside the connector, they should not easily move from where they are correctly placed, which would produce an opening of the corresponding electrical circuit.

The function of the connectors in complex electrical assemblies is multifaceted. In the first place the productivity or economies of placing the terminals inside the connector should be enhanced. Second, the connector should enable a user to check that the operation has been correctly performed. Further, the connector's inside configuration should provide a total certainty that in the moment of the connection among a male and a female connector any extraction of a terminal does not happen. Once the terminals are connected, they should not become dislodged as a consequence of the vehicle's vibration. Once installed, a connector's terminal should not move or come loose, which would have the effect of opening some circuits of the electrical installation.

The present application provides a connector that meets the needs state above, which were not met by the prior art. The inventive design is especially well-suited for lateral insertion or introducing the terminal and the wire inside the connector from the side.

SUMMARY OF THE INVENTION

The present invention provides a quick lateral insertion connector. This invention also provides the insurance that, once the terminal is laterally inserted, it cannot move either in the lateral direction in which it has been introduced or upwards or downwards.

The connector includes a special design of the cells disposed inside the connector. The cells have a mainly prismatic configuration and are devoid of upper, lower and lateral bases. A protuberance exists in one of the cell faces cooperating with the specific terminal configuration. In the upper part of each cell the protuberance is integral with the walls of the cell. Tabs extend from the walls of each cell, at an angle of less than 90°. Once the terminal is introduced and fixed in the corresponding recess, the portion of the wire hanging out of the terminal is introduced in the tabs and once this operation is made it becomes impossible to dislodge it from the cell, either laterally or vertically in both directions.

Other details and characteristics of the present invention will be manifest through the reading of the detailed description given below, in which reference is made to the figures. The details are given as an example, referring to a case of a possible practical embodiment, but the invention is not limited to the details outlined. Therefore, the detailed description must be considered from an illustrative point of view and with no limitations whatsoever.

DETAILED DESCRIPTION OF THE PREFERRED EMBODIMENTS

Figure 1:
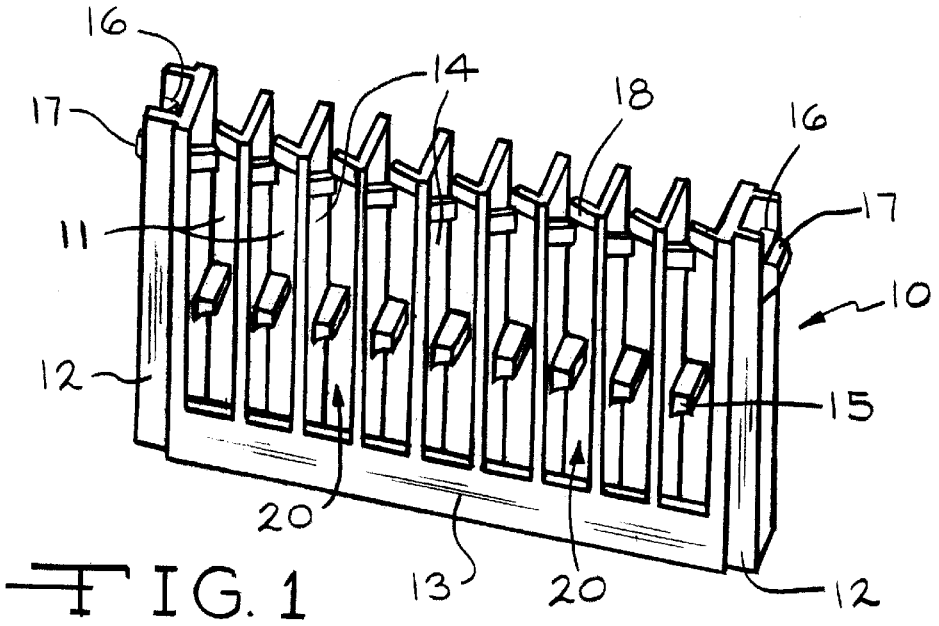
FIG. 1 is a perspective view of a connector designed according to this invention.
Figure 2:
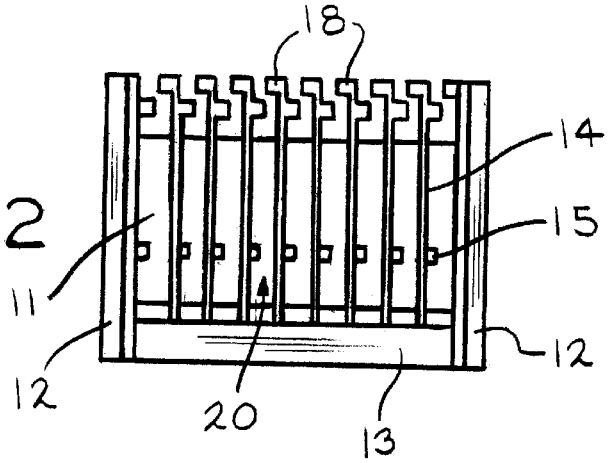
FIG. 2 is an elevational front view of the connector embodiment of FIG. 1.
Figure 3:
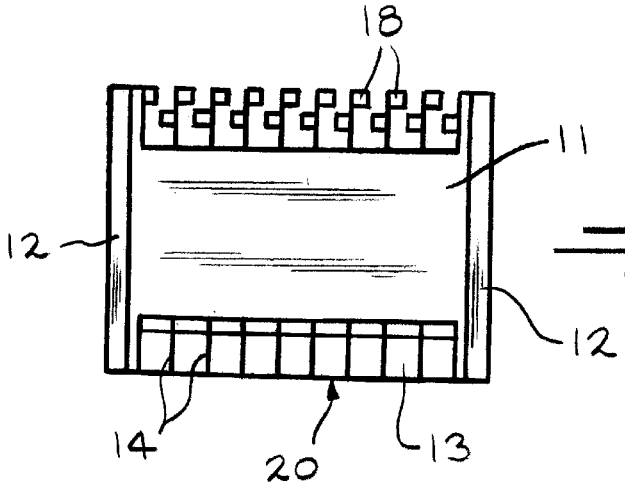
FIG. 3 is an elevational rear view of the connector embodiment of FIG. 1.

As can be seen in FIG. 1, the connector 10 has a basically prismatic configuration formed with two relatively smaller lateral supports 12 at opposite ends with a lateral reinforcement 13 extending between the lower portions of the lateral supports 12. The lateral supports 12 are also joined by a main lateral base 11 which extends between the supports 12 on the opposite side of the connector (i.e., opposite from the lateral reinforcement 13).

In its interior the connector 10 is divided in a series of cells 20 of a basically prismatic configuration and having only two thin walls 14 being totally void in the remainder of the cell 20.

In the cells 20, protuberances 15 are disposed at a preselected position along the length of the walls 14. In the upper part of the thin walls 14 appear wings or tabs 18 forming an angle that preferably is less than 90° with the thin walls 14, as can be seen in FIG. 1.

The inventive arrangement provides the advantage that the terminal connected to the end of the wire (not shown in the Figures) is inserted inside of the cells 20 in a lateral way and, in the first place, the terminal is kept retained because of the protuberance 15 while the part of the wire hanging from the terminal passes through the wings 18 and after this moment cannot get out of the cells because it is being impeded by the wings 18. In other words, when a terminal is placed within a cell 20, the terminal body is held in position by the protuberance 15 while the wire associated with the terminal is held in position between the wings 18.

In a conventional way the smaller bases 12 preferably are provided with tabs 16 supporting rods 17, whose object is that of inserting the connector 10 into boxes for connectors.

The preceding description is exemplary and not limiting in nature. It is to be understood that any detail modifications regarded as convenient can be introduced without departing from the essence of the present invention as summarized in the following claims.

The following is claimed:

1. A connector device for receiving and supporting a wire having a terminal on the end thereof, said device comprising:

a first lateral support at a first end;

a second lateral support at a second end opposite from said first end;

a plurality of walls generally aligned with and disposed between said first and second lateral supports, each of said walls defining a cell between each said wall and an adjacent one of said walls for receiving a terminal of a wire, each said wall including a protuberance extending from said wall for retaining the terminal of the wire disposed in said cell after lateral insertion in said cell;

a lateral reinforcement extending between said first and second lateral supports and supporting at least one end of said plurality of walls;

a lateral base extending between said first and second lateral supports and supporting said plurality of walls; and a tab extending from each one of said plurality of walls near an end of said walls opposite said lateral reinforcement for retaining a wire disposed in said cell.

2. The device of claim 1, wherein said lateral supports, said lateral reinforcement, said lateral base, and said plurality of walls are all generally planar, said lateral supports and said walls are generally parallel to each other, and wherein said lateral reinforcement and said lateral base are generally perpendicular to said lateral supports and said walls.

3. The device of claim 1, wherein said lateral supports and said walls each have a length that is equal.

4. The device of claim 1, wherein said connector has a second lateral face that is covered along a central portion by said lateral base and wherein opposite ends of said second lateral face are generally open such that a terminal can be laterally inserted into said first lateral face of said connector.

5. The device of claim 1, wherein said walls, said lateral supports, said lateral reinforcement, and said lateral base are integrally formed from a plastic material.

6. The device of claim 1, wherein said lateral reinforcement extends only along a portion of said walls and said lateral base is positioned between said tabs and said lateral reinforcement along a length of said walls.

7. The device of claim 6, wherein said lateral base extends along a substantial portion of said walls and said lateral base is positioned over a central portion of the length of said walls.

8. The device of claim 1, wherein said lateral reinforcement is joined to said walls along a first edge of said walls and said lateral base is joined to said walls along a second edge of said walls.

9. The device of claim 8, wherein said lateral reinforcement extends over a first portion of a length of said walls and said lateral base extends over a second portion of the length of said walls and wherein said second portion of the length is greater than said first portion.

10. The device of claim 9, wherein said tabs are near an end of said walls that is opposite from said first lateral base and said tabs extend from said walls at an angle that is less than 90 degrees.

11. The device of claim 9, wherein each said protuberance is generally aligned with a remainder of said protuberances and positioned at a selected position within said second portion of said length of said walls.

* * * * *

UNITED STATES PATENT AND TRADEMARK OFFICE

CERTIFICATE OF CORRECTION

PATENT NO. : 6,276,959 B1 
DATED : August 21, 2001
INVENTOR(S) : Xavier Secall Manresa It is certified that error appears in the above-identified patent and that said Letters Patent is hereby corrected as shown below:

Column 3,
Line 6, delete "." and insert -- ; --.
After line 6, add a separate paragraph: -- wherein said connector has a first lateral face that is substantially open, said lateral reinforcement is supported along a portion of said lateral face, and wherein insertion of the wire is in a direction normal to a plane in which said lateral face lies. --

Signed and Sealed this

Twelfth Day of August, 2003

JAMES E. ROGAN
*Director of the United States Patent and Trademark Office*